US007621619B2

(12) United States Patent
Sakakitani

(10) Patent No.: US 7,621,619 B2
(45) Date of Patent: Nov. 24, 2009

(54) INK JET RECORDING APPARATUS WITH HIGHER FLEXIBILITY IN LAYOUT OF COMPONENTS

(75) Inventor: Masatoshi Sakakitani, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 475 days.

(21) Appl. No.: 11/484,987

(22) Filed: Jul. 11, 2006

(65) Prior Publication Data

US 2007/0013735 A1 Jan. 18, 2007

(30) Foreign Application Priority Data

Jul. 12, 2005 (JP) ..... 2005-202975

(51) Int. Cl.
*B41J 2/165* (2006.01)
*G03G 21/12* (2006.01)
*G03G 15/08* (2006.01)

(52) U.S. Cl. ..... 347/36; 399/35; 399/120

(58) Field of Classification Search ..... 347/84, 347/85, 36, 22, 29–35; 399/358, 360, 35, 399/106, 120
See application file for complete search history.

(56) References Cited

U.S. PATENT DOCUMENTS 5,132,740 A * 7/1992 Okamoto et al. ..... 399/360
5,384,629 A * 1/1995 Watanabe et al. ..... 399/120
5,589,915 A * 12/1996 Hashimoto ..... 399/120
5,604,568 A * 2/1997 Iwama ..... 399/215
6,361,142 B1 * 3/2002 Otsuka et al. ..... 347/36
6,695,429 B2 * 2/2004 Barinaga ..... 347/28
7,020,428 B2 * 3/2006 Park et al. ..... 399/360
7,221,887 B2 * 5/2007 Kimura et al. ..... 399/101
2005/0194730 A1 9/2005 Nishida et al.
2006/0050104 A1 3/2006 Sakakitani

FOREIGN PATENT DOCUMENTS

JP 11-334110 12/1999
JP 2005-254636 9/2005
JP 2005254636 A * 9/2005

* cited by examiner

*Primary Examiner*—Stephen D Meier
*Assistant Examiner*—Rene Garcia, Jr.
(74) *Attorney, Agent, or Firm*—Cooper & Dunham, LLP

(57) ABSTRACT

An ink jet recording apparatus includes a recording head, a maintenance recovery unit for maintaining and recovering a state of the recording head, a waste liquid tank removably loaded to the maintenance recovery unit to store a waste liquid from the maintenance recovery unit, a shutter mechanism arranged between the maintenance recovery unit and the waste liquid tank and including a shutter member which moves between a closed position at which the maintenance recovery unit is isolated from the waste liquid tank and an open position at which the maintenance recovery unit is linked to the waste liquid tank and a close mechanism which causes the shutter member to stay at the closed position, and a holding member removably inserted to the ink jet recording apparatus in a first direction and causes the shutter member to move to the open position in a second direction opposite to the first direction.

14 Claims, 9 Drawing Sheets

INK JET RECORDING APPARATUS WITH HIGHER FLEXIBILITY IN LAYOUT OF COMPONENTS

BACKGROUND

1. Field

This patent specification describes an ink jet recording apparatus, and more particularly an ink jet recording apparatus with a high degree of flexibility in layout of components included therein.

2. Discussion of the Background

A background ink jet recording apparatus includes a maintenance recovery mechanism for maintaining and restoring an ink discharge function in and to normal condition. In the background ink jet recording apparatus, since a drop of ink is discharged through a fine opening, the ink becomes viscous or solidifies due to evaporation. Viscous or solidified ink may cause the opening to be clogged with the ink, thereby resulting in defective ink discharge. A bubble generated in ink may also cause the opening to be clogged, and discharge of the ink may be hampered. A maintenance and recovery mechanism is provided in the background ink jet recording apparatus to prevent defective ink discharge.

Generally, the maintenance and recovery mechanism adopts any one or a combination of methods of restoring the ink discharge function. The methods include a discharge opening recovery method in which a recording head is filled with ink by using a pressurization mechanism or the like, a preparatory discharge method in which a discharge operation is performed without actually performing a recording operation, and a wiping method in which a nozzle face of the recording head is wiped off.

Since the maintenance recovery mechanism performs an operation for restoring performance of the recording head, waste ink which has not been used for recording is drained. Therefore, the background ink jet recording apparatus is provided with a waste liquid tank for storing the waste ink.

Recently, there has been new demand for an ink jet recording apparatus from a business use viewpoint. In response to the demand, another background ink jet recording apparatus is provided with a removable waste liquid tank which facilitates replacement and maintenance of the waste liquid tank. The background ink jet recording apparatus includes a shutter mechanism arranged between a maintenance recovery mechanism and the waste liquid tank. The shutter mechanism is configured to close a shutter when the waste liquid tank is removed so that ink dripped from the maintenance recovery mechanism after the waste liquid tank is removed does not stain components of the background ink jet recording apparatus. The shutter mechanism is configured such that loading a waste liquid tank opens the closed shutter.

However, in the background ink jet recording apparatus having such a shutter mechanism, as the waste liquid tank pushes the shutter to open, there is often insufficient space for the shutter to move inward.

SUMMARY

This patent specification describes a number of improvements to an ink jet recording apparatus and methods for maintaining the apparatus. An exemplary embodiment of an ink jet recording apparatus including a recording head, a maintenance recovery unit configured to maintain and restore a state of the recording head, a waste liquid tank removably loaded to the maintenance recovery unit so as to store a waste liquid from the maintenance recovery unit, a shutter mechanism arranged between the maintenance recovery unit and the waste liquid tank and including a shutter member configured to move between a closed position at which the maintenance recovery unit is isolated from the waste liquid tank and an open position at which the maintenance recovery unit is linked to the waste liquid tank and a close mechanism configured to cause the shutter member to stay at the closed position, and a holding member configured to be removably inserted to the ink jet recording apparatus in a first direction and to cause the shutter member to move to the open position in a second direction opposite to the first direction. Thus, the shutter mechanism has sufficient space for the shutter to open properly and reliably.

An example of an improved method for maintaining an ink jet recording apparatus includes operating a maintenance unit in the ink jet recording apparatus to maintain a state of the recording head, storing a waste liquid from the maintenance unit in a waste liquid tank in the ink jet recording apparatus, moving a shutter member in the ink jet recording apparatus between (i) a closed position at which the maintenance unit is isolated from the waste liquid tank and (ii) an open position at which the maintenance unit is liked to the waste liquid tank, inserting a holding member into the ink jet recording apparatus in a first direction, and allowing the holding member to cause the shutter member to move to the open position in a second direction opposite to the first direction.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
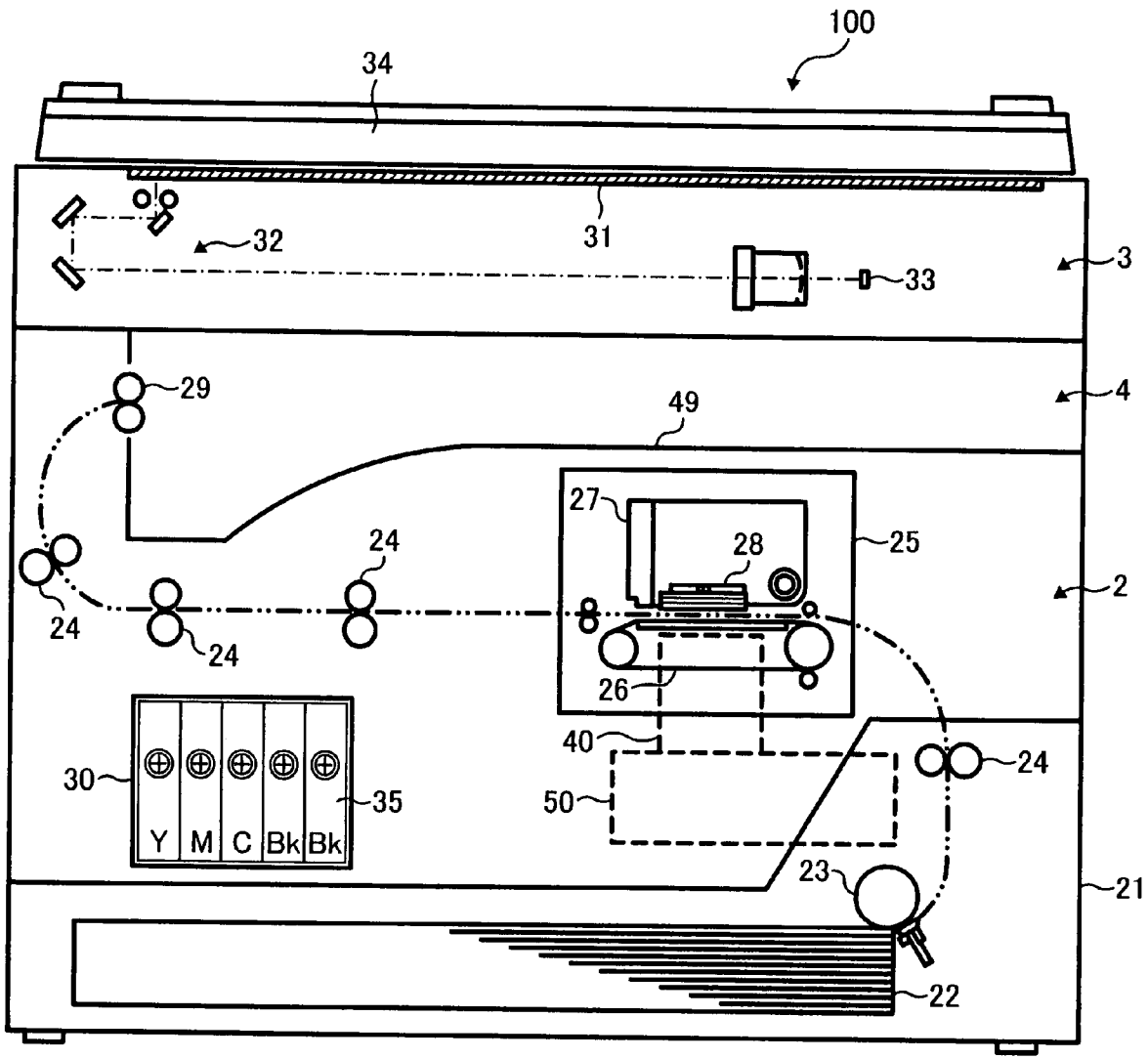
FIG. 1 is a cross section view of an ink jet copier according to an exemplary embodiment of the present disclosure.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an ink jet copier according to a preferred embodiment is described.

A general configuration of an ink jet copier 100 which serves as an ink jet recording apparatus according to an exemplary embodiment of the present disclosure is described below referring to drawings.

FIG. 1 is a cross section view of the ink jet copier 100. A direction perpendicular to the cross section view is a main scanning direction of the ink jet copier 100.

As shown in FIG. 1, the ink jet copier 100 includes a printer unit 2, a scanner unit 3, and a sheet discharge unit 4. Alternatively, an ink jet recording apparatus according to another example of the present disclosure may be represented by a multifunction apparatus including a printer function and a facsimile function.

The printer unit 2 is located in a lower part of the ink jet copier 100. The scanner unit 3 is located in an upper part of the ink jet copier 100. The sheet discharge unit 4 is located between the printer unit 2 and the scanner unit 3.

The scanner unit 3 includes an exposure glass 31, a scan mechanism 32, a charge-coupled device (hereinafter referred to as CCD) 33, and a pressing plate 34.

The printer unit 2 includes a sheet feeding unit 21, an ink jet engine 25, a plurality of conveyance rollers 24, and a pair of sheet discharge rollers 29, an ink cartridge attachment unit 30. The printer unit 2 further includes a maintenance recovery unit 40 and a waste liquid tank 50 (indicated by broken lines). The printer unit 2 further includes a side cover (not shown). The sheet feeding unit 21 includes a sheet cassette 22, a sheet feeding mechanism 23, and so forth. The ink jet engine 25 includes an electrostatic attachment belt 26 and a carriage 27 having a printhead 28 with a nozzle (not shown). The ink cartridge attachment unit 30 includes five ink cartridges 35.

The sheet discharge unit 4 includes a sheet discharge tray 49.

In the scanner unit 3, the scan mechanism 32 is arranged below the exposure glass 31 in a mobile manner. The pressing plate 34 is arranged above the exposure glass 31 in an openable and closable manner.

In the printer unit 2, the sheet feeding unit 21 is located in a lower part of the printer unit 2. The ink jet engine 25 and the ink cartridge attachment unit 30 are located above the sheet feeding unit 21. The maintenance recovery unit 40 is located below the printhead 28. In detail, the maintenance recovery unit 40 is arranged below a non-printing area located at one end of the carriage 27 in the main scanning direction (a back side of the ink jet copier 100). The waste liquid tank 50 is located below the maintenance recovery unit 40. The waste liquid tank 50 is arranged in the ink jet copier 100 in an unloadable and re-loadable manner. The side cover is openably arranged on a right side face of the printer unit 2.

In the scanner unit 3, an original placed on the exposure glass is irradiated with light emitted from a light source. The light is reflected from the original, and is led through a mirror, a lens, and so forth into CCD 33 so that an image on the original is read.

In the printer unit 2, the sheet cassette 22 stores a recording medium such as a transfer sheet. The sheet feeding mechanism 23 feeds sheets one after another from the sheet cassette 22. The plurality of conveyance rollers 24 are properly arranged at respective predetermined positions along a sheet conveyance path arranged between the sheet feeding unit 21 and the sheet discharge unit 4 as shown by an alternate long and short dashed line in FIG. 1 so that the sheet is discharged by the sheet discharge roller 29 into the sheet discharge tray 49.

Since the ink jet engine 25 adopts a sheet conveyance system using the electrostatic attachment belt 26, the ink jet engine 25 achieves higher stability in sheet feeding as compared to a background ink jet engine adopting a roller conveyance method. The carriage 27 makes a reciprocating motion in the main scanning direction for printing. The printhead 28 includes four heads, one head for each of four colors, cyan (C), magenta (M), yellow (Y), and black (Bk). Alternatively, the printhead 28 may include two heads, with each head for two of the four colors. The number of heads included in the printhead 28 is not limited thereto.

The cartridge attachment unit 30 of the ink jet copier 100 includes five ink cartridges in total for yellow (Y), magenta (M), cyan (C), and black (Bk) separately arranged from the printhead 28. Ink stored in the ink cartridges 35 is supplied to the printhead 28 through a supply tube (not shown). When ink cartridges are mounted separately from a printhead, the ink cartridges may have large capacity so as to cope with increased ink consumption due to increased print speed. Such a method is suitable for a business use. Further, in the present exemplary embodiment, two ink cartridges are mounted for black (Bk) to accommodate a great amount of consumption.

The maintenance recovery unit 40 maintains and restores a state of the nozzle of the printhead 28 to a relatively clean state.

The term "clean state" is used broadly herein to cover any state of the nozzle of the printhead in which the nozzle is relatively free of blockage (such as bubbles and/or viscous or solidified ink) and accumulation of viscous or solidified ink, such that there is little or no difficulty in the ink discharge process.

The maintenance recovery unit 40 according to the exemplary embodiment is configured to perform a preparatory discharge operation (without actually performing a recording operation), and a wiping operation for wiping off the nozzle. The waste liquid tank 50 receives ink discharged during the preparatory discharge operation. When the waste liquid tank 50 is replaced with another waste liquid tank 50, the side cover of the printer unit 2 is opened.

Figure 2:
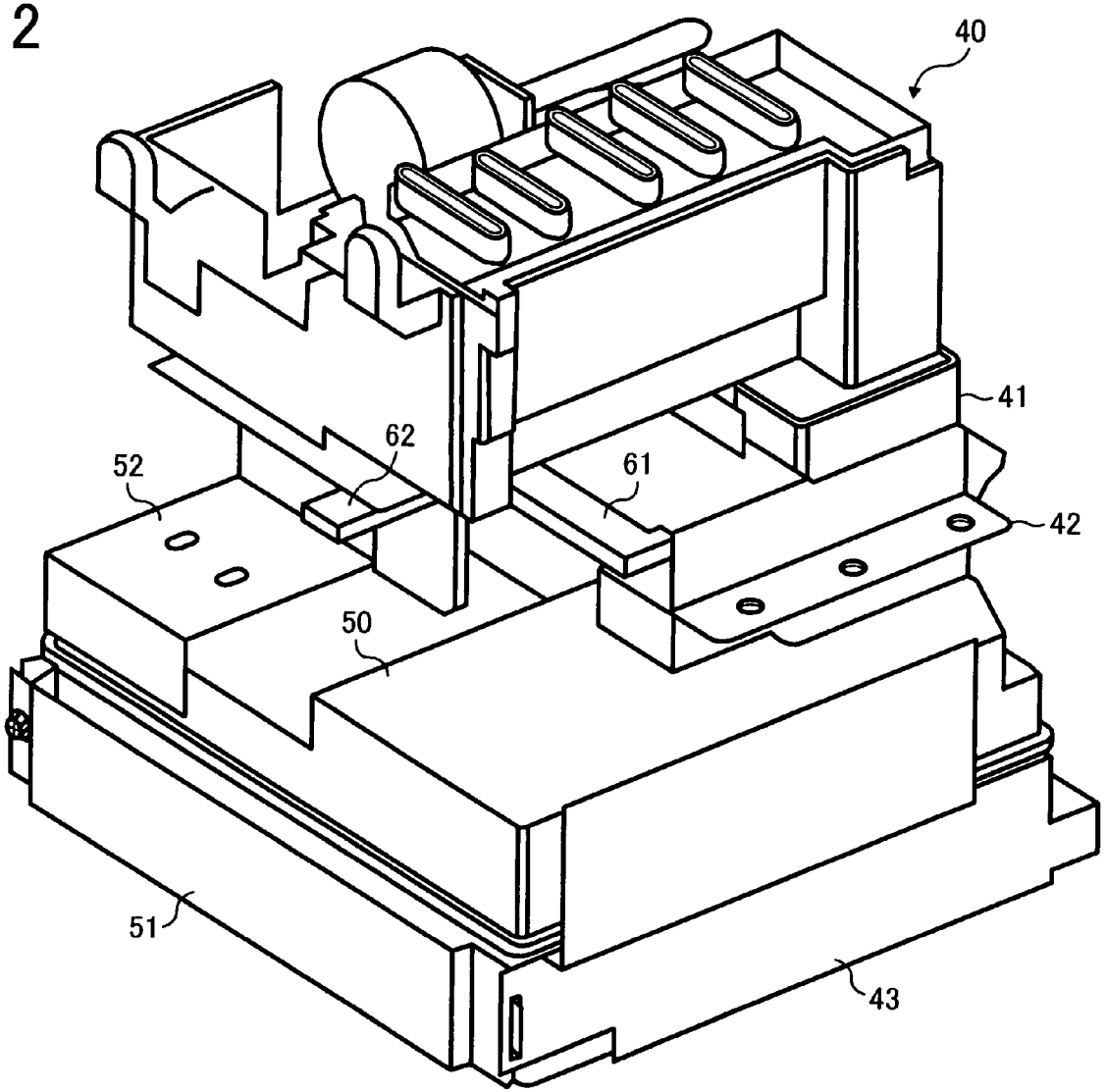
FIG. 2 is a perspective view of a maintenance recovery unit and a waste liquid tank included in the ink jet copier shown in FIG. 1.
Figure 3:
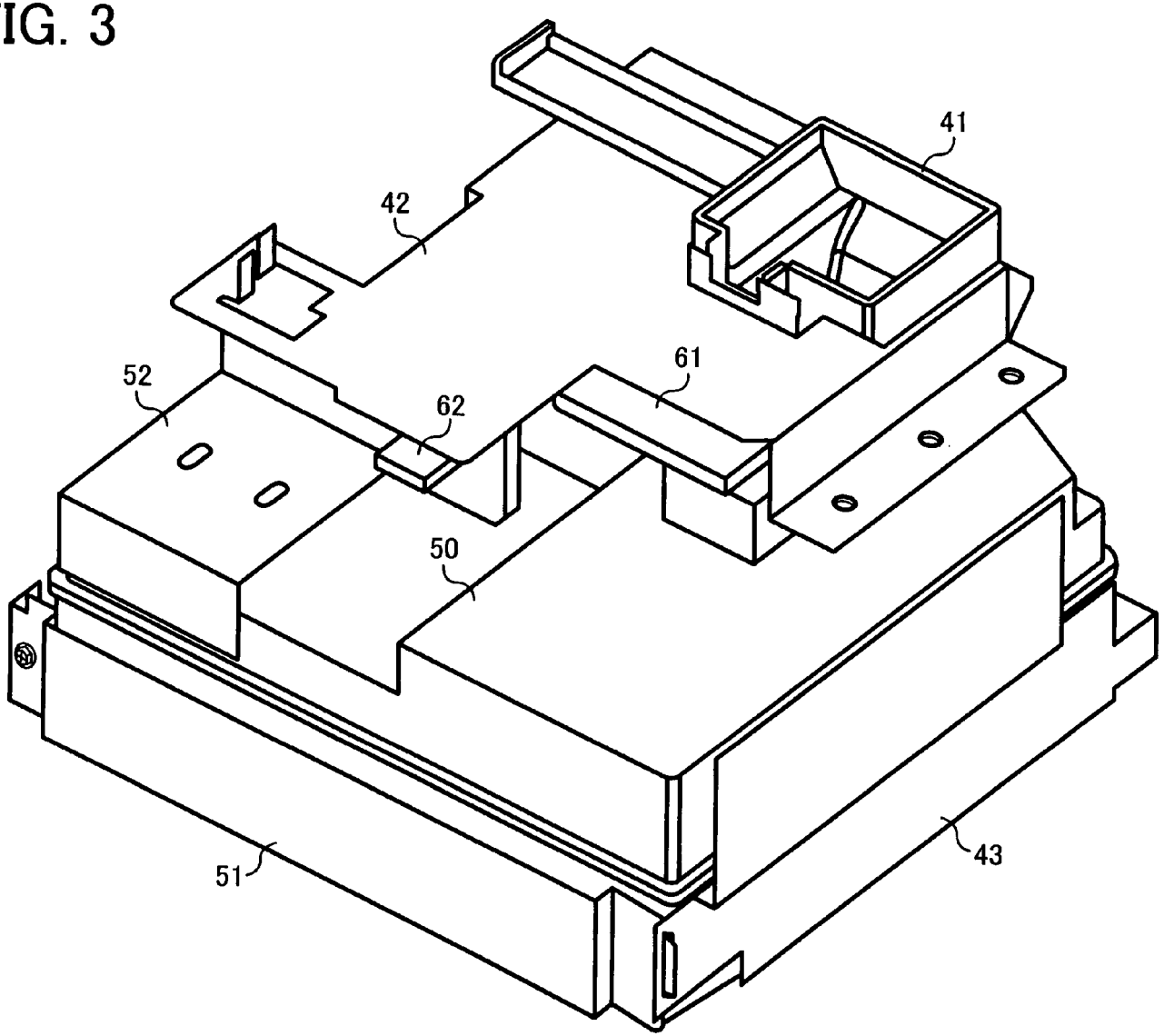
FIG. 3 is a perspective view of the waste liquid tank of the ink jet copier shown in FIG. 1, with the maintenance recovery unit removed.

FIG. 2 illustrates the maintenance recovery unit 40 and the waste liquid tank 50 included in the ink jet copier 100 shown in FIG. 1. FIG. 3 illustrates the waste liquid tank 50 of the ink jet copier 100 with the maintenance recovery unit 40 removed.

Figure 4:
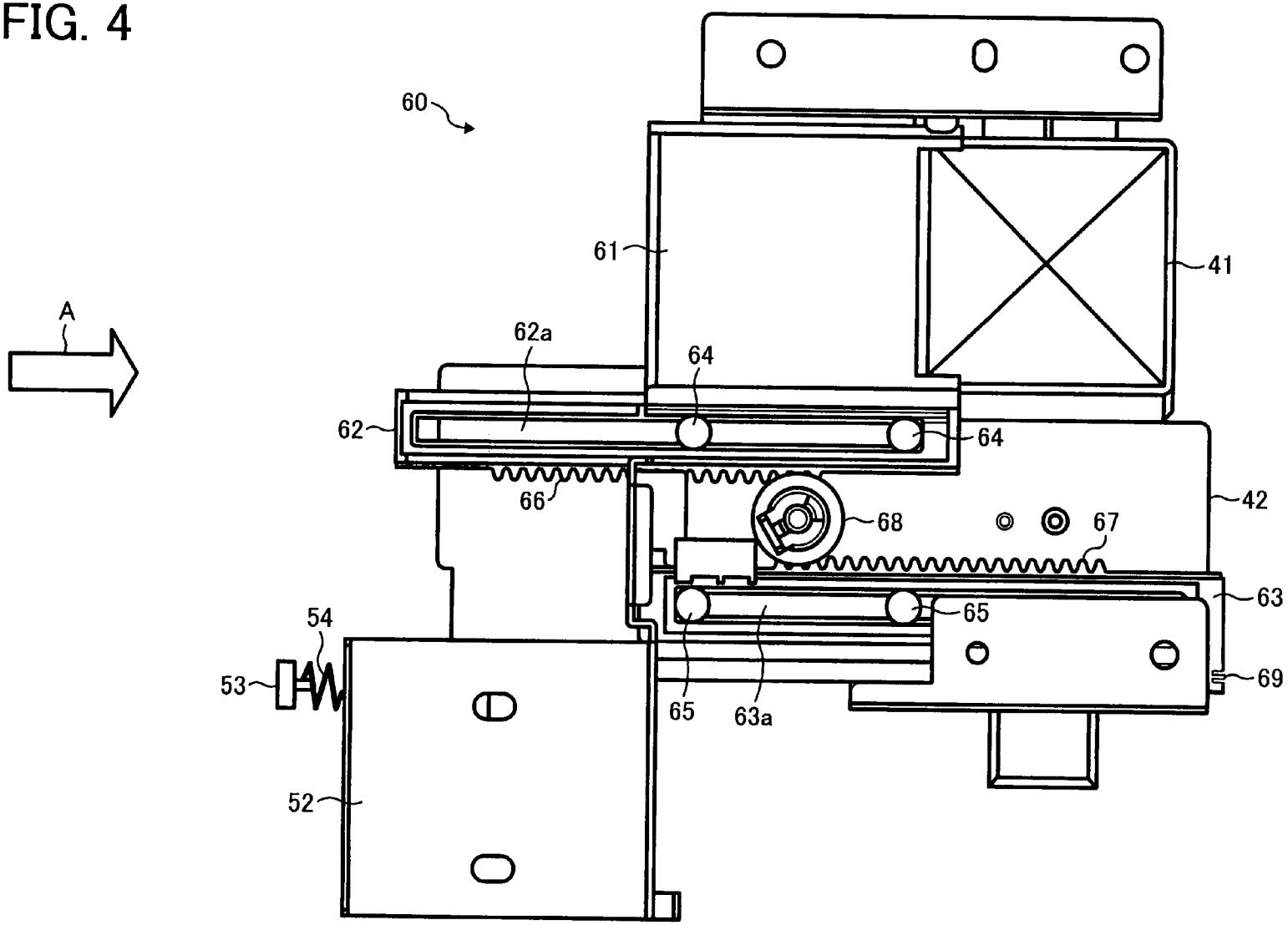
FIG. 4 is a bottom view of a shutter mechanism of the ink jet copier shown in FIG. 1, in an open state.

As shown in FIGS. 2 and 3, the ink jet copier 100 further includes a duct 41, a bracket 42, a side plate 43, a tank fixing member 51, a shutter open close bracket 52 which serves as a holding member, and a shutter member 61 and a rack member 62 included in a shutter mechanism 60 (shown in FIG. 4).

The duct 41 is located between the maintenance recovery unit 40 and the waste liquid tank 50, and links the maintenance recovery unit 40 with the waste liquid tank 50. The shutter mechanism 60 is attached to and supported by a bottom face of the bracket 42. In other words, the shutter mechanism 60 is attached to the maintenance recovery unit 40 through the bracket 42. As the bracket 42 is fixed to a body of the ink jet copier 100, the maintenance recovery unit 40 (and the shutter mechanism 60) is supported by the body above (and on) the waste liquid tank 50. A lower opening of the duct 41 is located on an opening (not shown) of the waste liquid tank 50 for receiving ink.

The waste liquid tank 50 included in the body in the unloadable and re-loadable manner is provided with the tank fixing member 51 for fixing the waste liquid tank 50 to the body. The tank fixing member 51 is arranged on a side face of the waste liquid tank 50. A right end (in FIG. 2) of the tank fixing member 51 is engaged with the side plate 43 arranged on a side of the body. A left end (in FIG. 2) of the tank fixing member 51 is screwed to the body. Further, the shutter open close bracket 52 is arranged above one side of the tank fixing member 51. The shutter open close bracket 52 is fixed to the body with a fixing part (not shown) so as to hold a side face of the waste liquid tank 50. The waste liquid tank 50 is unloadable from the body by removing the tank fixing member 51 and the shutter open close bracket 52.

Figure 5:
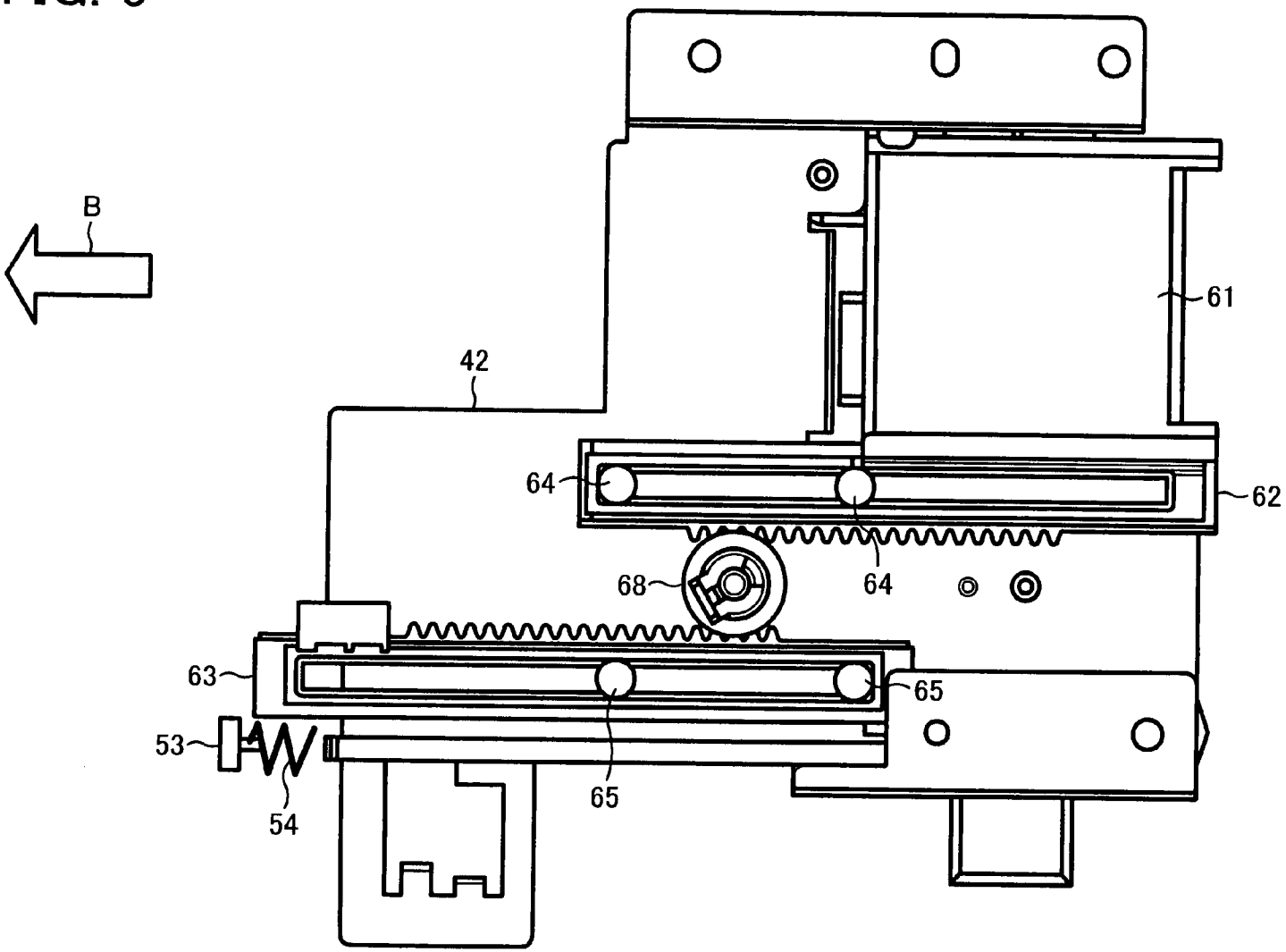
FIG. 5 is a bottom view of the shutter mechanism of the ink jet copier shown in FIG. 1, in a closed state.

A configuration and operation of the shutter mechanism 60 are described below referring to FIGS. 4 and 5. FIG. 4 is a bottom view of the shutter mechanism 60 in an open state. FIG. 5 is a bottom view of the shutter mechanism 60 in a closed state.

As shown in FIGS. 4 and 5, the shutter mechanism 60 includes the shutter member 61, a pair of rack members 62 and 63, a pinion gear 68, and so forth. The shutter member 61 and the rack member 62 are integrally formed. The rack members 62 and 63 are provided with slits 62*a* and 63*a*, respectively.

The shutter mechanism 60 further includes a plurality of support members 64 and a plurality of support members 65. The rack members 62 and 63 are provided with racks 66 and 67, respectively. Further, the shutter mechanism 60 is provided with a close mechanism including a spring stop part 53, a tension spring 54 (partially shown), and another spring stop part 69.

The shutter mechanism 60 can be provided with a rack-and-pinion mechanism. The plurality of support members 64 and the plurality of support members 65 are attached to the bottom face of the bracket 42, and are loosely fit to the slits 62*a* and 63*a*, respectively, so that the rack members 62 and 63 are able to slide on the bottom face of the bracket 42. The racks 66 and 67 are formed on respective faces of the rack members 62 and 63 opposing to each other. The racks 66 and 67 are engaged with the pinion gear 68 rotatably supported by the bottom face of the bracket 42. Therefore, the rack member 62 (and the shutter member 61) and the rack member 63 are able to slide in gearing with each other in opposing directions (to the right and the left in FIG. 4) to each other.

The spring stop part 69 is arranged at one end of the rack member 63. The tension spring 54 is stretched between the spring stop part 69 and the spring stop part 53. Therefore, the rack member 63 is applied with force to the left in FIG. 4. The spring stop part 53 is arranged on the maintenance recovery unit 40.

As shown in FIG. 4 (and FIGS. 2 and 3), when the shutter open close bracket 52 is attached (screwed) to the body of the ink jet copier 100, the shutter open close bracket 52 presses the rack member 63 to the right in FIG. 4 (towards inside the body). As a result, the rack member 62 (and the shutter member 61) travels to the left in FIG. 4 (towards outside the body), thereby releasing the lower opening of the duct 41. In other words, the shutter mechanism 60 is in the open state. The shutter open close bracket 52, when being attached to the body, serves as the holding member for holding the shutter member 61 in an open position.

As shown in FIG. 5, when the shutter open close bracket 52 is removed from the body, the force applied to the rack member 63 by the shutter open close bracket 52 is released, and the rack member 63 travels to the left in FIG. 5 (towards outside the body) due to tensile force of the tension spring 54. As a result, the rack member 62 (and the shutter member 61) travels to the right in FIG. 5 (towards inside the body), and the shutter member 61 is placed under the duct 41, thereby blocking the lower opening of the duct 41. In other words, the shutter mechanism 60 is in the closed state.

In the preferred embodiment, when the waste liquid tank 50 needs to be unloaded from the body of the ink jet copier 100, the shutter open close bracket 52 is removed, and the tank fixing member 51 shown in FIGS. 2 and 3 is removed. Then, the waste liquid tank 50 is pulled out of the body (in a direction of an arrow B). As the shutter open close bracket 52 is removed, the shutter mechanism 60 is concomitantly put in the closed state as described above, thereby preventing ink from dripping down from the maintenance recovery unit 40 through the duct 41 into the body with the waste liquid tank 50 removed. As a result, the body may be prevented from being stained with ink.

When the waste liquid tank 50 is reloaded to the body, the waste liquid tank 50 is set inside the body, and the tank fixing member 51 is attached thereto. Further, the shutter open close bracket 52 is inserted to press the rack member 63 into the body against the tensile force of the tension spring 54, and the shutter open close bracket 52 is fixed to the body. As the shutter open close bracket 52 is attached to the body, the shutter mechanism 60 is concomitantly opened.

The shutter open close bracket 52 is provided to hold the side face of the waste liquid tank 50 as described above, when the waste liquid tank 50 is unloaded from the body, and when the shutter open close bracket 52 is removed. The shutter member 61 may be provided with a concave portion on a top face thereof so that a waste liquid from the maintenance recovery unit 40 may be received. Even when ink is dripped onto the shutter member 61, the concave portion may prevent the ink from staining inside the body.

Further, the shutter member 61 may be provided with an absorbent member on the top face thereof so that the waste liquid from the maintenance recovery unit 40 may be received. Even when ink is dripped onto the shutter member 61, the absorbent member may prevent the ink from staining inside the body.

In the preferred embodiment, the rack-and-pinion mechanism is provided between the shutter member 61 and the shutter open close bracket 52 which serves as the holding member for holding the shutter member 61. Therefore, the shutter open close bracket 52 and the shutter member 61 slide in opposite directions to each other. In detail, a direction in which the shutter open close bracket 52 travels so as to be attached to the body (as shown by an arrow A in FIG. 4) is opposite to a direction in which the shutter member 61 travels to open the shutter mechanism 60. Further, a direction in which the shutter open close bracket 52 travels so as to be removed from the body (as shown by the arrow B in FIG. 4) is opposite to a direction in which the shutter member 61 travels to close the shutter mechanism 60. The waste liquid tank 50 is moved in the direction of the arrow A when being loaded to the body, and is moved in the direction of the arrow B when being unloaded from the body.

As described above, when the shutter mechanism 60 is in the open state, the shutter member 61 moves towards outside the body. In other words, a space for accommodating the shutter member 61 does not need to be arranged at an inner position of the duct 41. Therefore, the ink jet copier 100 has higher flexibility in layout of components thereof, which is suitable for a reduction in size of the ink jet copier 100.

Further, as described above, since the shutter mechanism 60 is attached to and supported by the bottom face of the maintenance recovery unit 40 through the bracket 42, when the bracket 42 and the maintenance recovery unit 40 are removed together from the body, engagement of the rack member 63 with the shutter open close bracket 52 (pressing force applied by the shutter open close bracket 52 to the rack member 63) is released. As a result, the tensile force of the tension spring 54 causes the shutter member 61 to move so that the shutter member 61 is placed under the duct 41, and the shutter mechanism 60 is thus put in the closed state. Therefore, in a case in which maintenance of the maintenance recovery unit 40 or other components of the ink jet copier 100 are to be performed, as the maintenance recovery unit 40 is removed together with the bracket 42 from the body, ink leakage from the maintenance recovery unit 40 is prevented.

The shutter open close bracket 52 may be formed integrally with other components of the ink jet copier 100.

Figure 6:
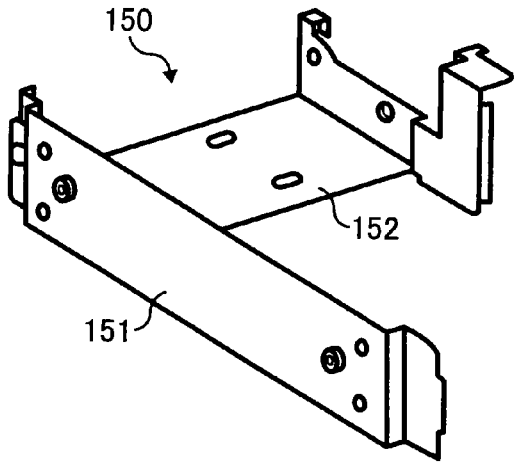
FIG. 6 is a perspective view of a bracket-integrated fixing member which can alternatively be included in the ink jet copier shown in FIG. 1.

For example, the shutter open close bracket 52 may be formed integrally with the tank fixing member 51. A bracket-integrated fixing member 150 shown in FIG. 6 includes a tank fixing part 151 and a shutter open close part 152 integrally formed therein. When the waste liquid tank 50 is unloaded from the body for replacement, removing the bracket-integrated fixing member 150 from the body causes the shutter mechanism 60 to close. As a result, the ink leakage from the maintenance recovery unit 40 is prevented. Further, a reduction in the number of components of the ink jet copier 100 leads to a reduction in time and efforts required for the replacement of the waste liquid tank 50.

When the waste liquid tank 50 is reloaded to the body, attaching the bracket-integrated fixing member 150 to the body causes the shutter open close part 152 to open the shutter mechanism 60. Therefore, the shutter mechanism 60 is prevented from being kept in the closed state. The tank fixing part 151 and the shutter open close part 152 does not need to be formed with a single member. Alternatively, the tank fixing part 151 and the shutter open close part 152 may be separately formed and fixed together to form the bracket-integrated fixing member 150.

Figure 7:
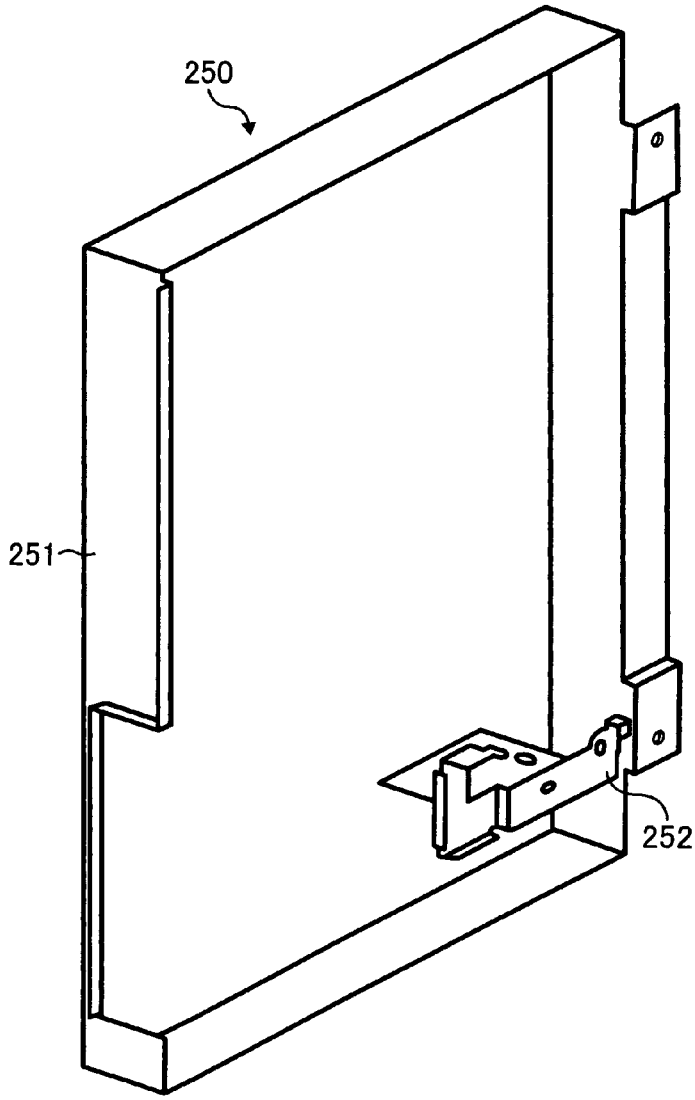
FIG. 7 is a perspective view of a bracket-integrated side cover which can alternatively be included in the ink jet copier shown in FIG. 1.

Further, the shutter open close bracket 52 may be formed integrally with a housing of the ink jet copier 100. A bracket-integrated side cover 250 shown in FIG. 7 includes a housing 251 and a shutter open close part 252 integrally formed therein. The housing 251 of the bracket-integrated side cover 250 also serves as a tank fixing part. When the waste liquid tank 50 is unloaded from the body for replacement, removing or releasing the bracket-integrated side cover 250 from the body causes the shutter mechanism 60 to close. As a result, the ink leakage from the maintenance recovery unit 40 is prevented. Further, a reduction in the number of components of the ink jet copier 100 leads to a reduction in time and efforts required for the replacement of the waste liquid tank 50.

When the waste liquid tank 50 is reloaded to the body, putting back the bracket-integrated side cover 250 causes the shutter open close part 152 to open the shutter mechanism 60. Therefore, the shutter mechanism 60 is prevented from being kept in the closed state. The housing 251 and the shutter open close part 252 does not need to be formed with a single member. Alternatively, the housing 251 and the shutter open close part 252 may be separately formed and fixed together to form the bracket-integrated side cover 250.

Further, the shutter open close bracket 52 may be formed integrally on the waste liquid tank 50. In one example, the bracket-integrated tank may be provided with a convex member which serves as a shutter open close bracket. Alternatively, the bracket-integrated tank may be provided with a shutter open close bracket separately formed and fixed onto a top face thereof. Unloading the bracket-integrated tank from the body causes the shutter mechanism 60 to close. Reloading the bracket-integrated tank to the body causes the shutter mechanism 60 to open. Therefore, the shutter mechanism 60 is prevented from being kept in the closed state. Further, the bracket-integrated tank may be easily unloaded and reloaded for replacement.

In the above preferred embodiment, although the shutter member 61 is moved by the rack-and-pinion mechanism, a mechanism for moving the shutter member 61 is not limited thereto. Alternatively, the shutter member 61 may be moved by a mechanism including a pulley and a wire member. An example of the mechanism is described below referring to FIGS. 8A through 8E. A material of the wire member is not limited to a wire, and the wire member refers to any member having a string (wire) form.

Figure 8A:
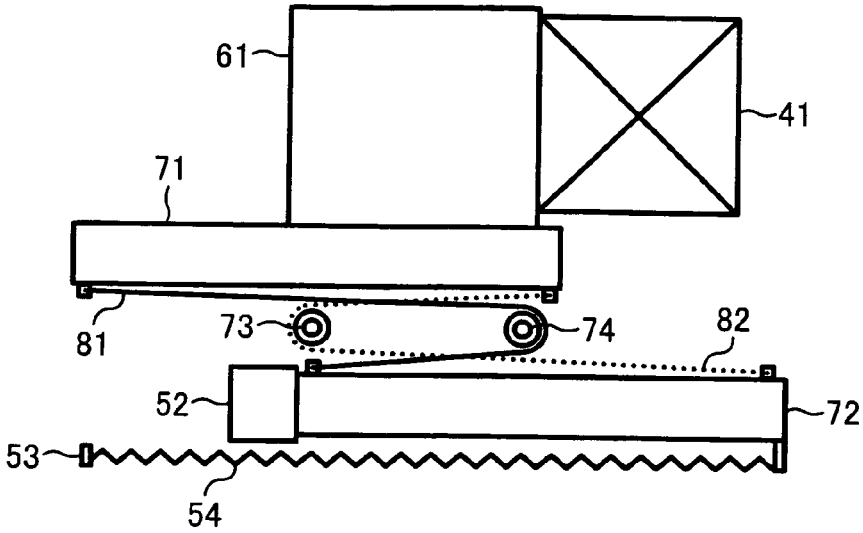
FIGS. 8A through 8E are schematic bottom views of an alternative mechanism for moving the shutter member shown in FIGS. 2-5.

As shown in FIG. 8A, the mechanism for moving the shutter member 61 includes a first travel member 71, a second travel member 72, a pulley 73, a pulley 74, a first wire 81, a second wire 82, and so forth.

The first wire 81 has an end attached to a left end of the first travel member 71, and another end attached to a left end of the second travel member 72, and is arranged such that the first wire 81 passes at one side of the pulley 74 as shown by a solid line in FIG. 8A. The second wire 82 has an end attached to a right end of the first travel member 71, and another end attached to a right end of the second travel member 72, and is arranged such that the second wire 82 passes at one side of the pulley 73 as shown by a broken line in FIG. 8A.

The shutter member 61 is fixed to the first travel member 71. When the shutter member 61 is placed in the open position, the shutter member 61 is placed at a left side of the duct 41 in FIG. 8A. The tension spring 54 is stretched between the spring stop part 53 and the right end of the second travel member 72.

As shown in FIG. 8A, when the shutter open close bracket 52 is attached (screwed) to the body, the shutter open close bracket 52 presses the second travel member 72 to the right (towards inside the body) to cause the shutter member 61 to be placed at the left side of the duct 41. As a result, the lower opening of the duct 41 is released. In the state, the tension spring 54 is stretched.

Figure 8B:
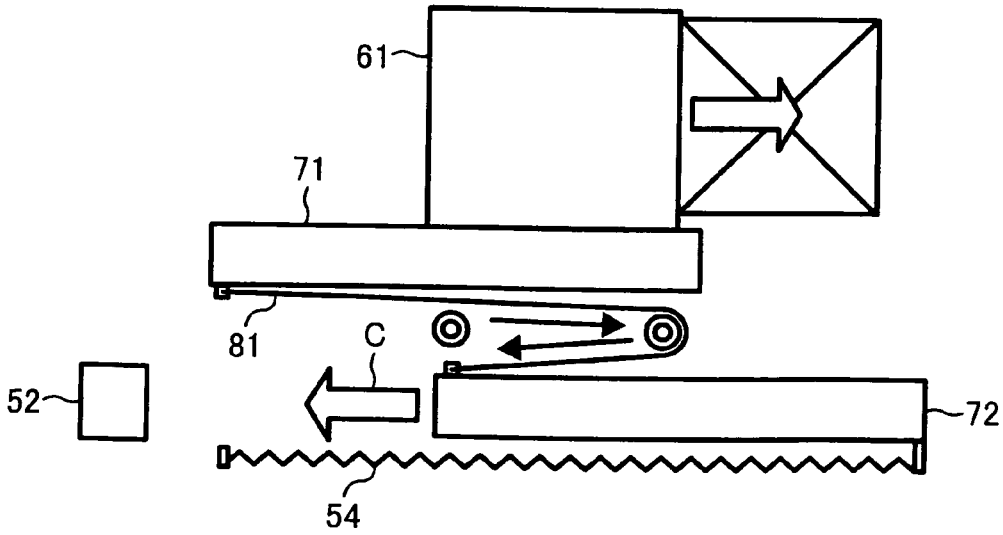
Figure 8C:
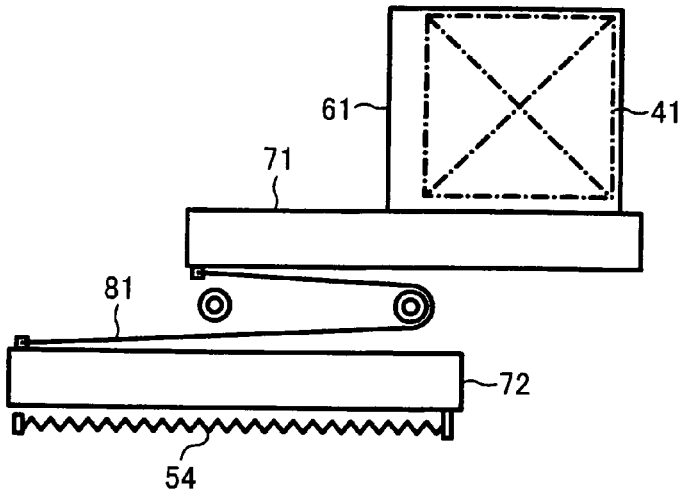
Figure 8D:
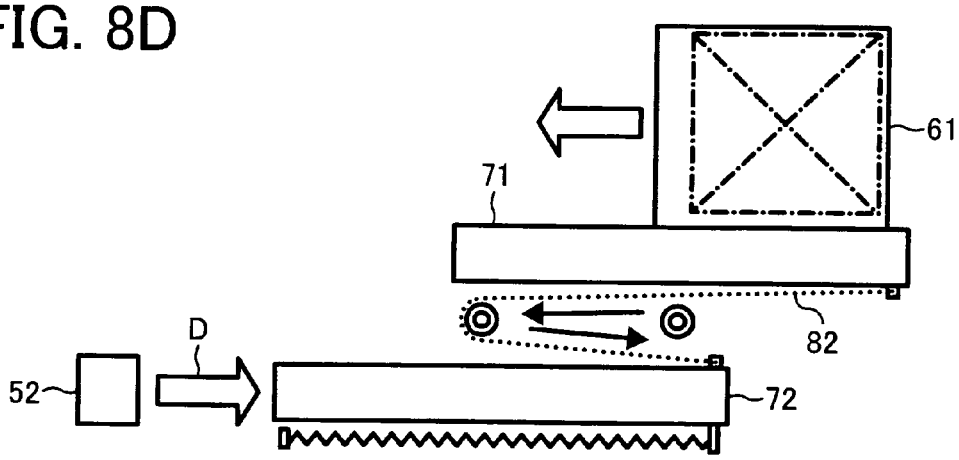
Figure 8E:
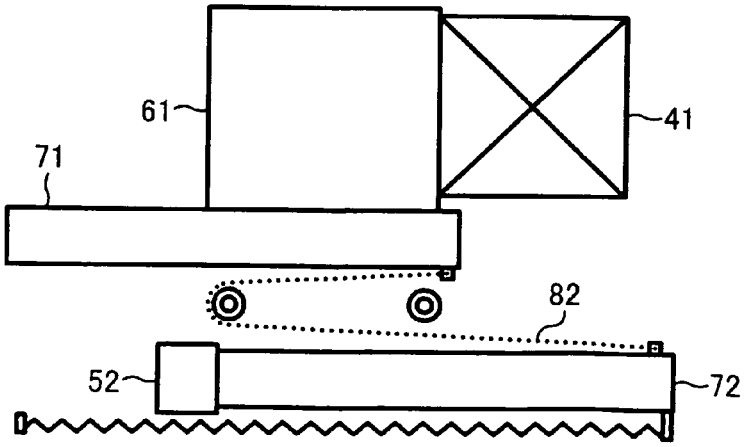

Illustrations in FIGS. 8B and 8C focus on the first wire 81 and illustrations in FIGS. 8D and 8E focus on the second wire 82 so that states of the first and second wires 81 and 82 are easily understood.

As shown in FIG. 8B, when the shutter open close bracket 52 is moved in a direction indicated by an arrow C, and is removed from the body, the second travel member 72 is pulled to the left by the tension spring 54. A part of the first wire 81 attached to the second travel member 72 is pulled to the left, and another part of the first wire 81 attached to the first travel member 71 is pulled to the right in FIG. 8B. As a result, the first travel member 71 and the shutter member 61 move to the right, and the shutter member 61 is placed under the duct 41 so that the lower opening of the duct 41 is blocked as shown in FIG. 8C.

As shown in FIG. 8D, when the shutter open close bracket 52 is moved in a direction indicated by an arrow D, and is attached to the body, the shutter open close bracket 52 presses the second travel member 72 to the right (towards inside the body). A part of the second wire 82 attached to the second travel member 72 is pulled to the right, and another part of the second wire 82 attached to the first travel member 71 is pulled to the left in FIG. 8D. As a result, the first travel member 71 and the shutter member 61 move to the left, the shutter member 61 is placed in the open position, and the lower opening of the duct 41 is released as shown in FIG. 8E.

In other wards, the above mechanism also causes the shutter open close bracket 52 and the shutter member 61 to slide in opposite directions to each other.

Although the shutter mechanism 60 is attached to the body through the bracket 42 in the preferred embodiment, arrangement of the shutter mechanism 60 is not limited thereto. Alternatively, the ink jet copier 100 may include another shutter mechanism integrally formed with other components. For example, the shutter member 61 may be formed integrally with the waste liquid tank 50. Alternatively, the shutter member 61 may be formed integrally with the maintenance recovery unit 40.

Figure 9:
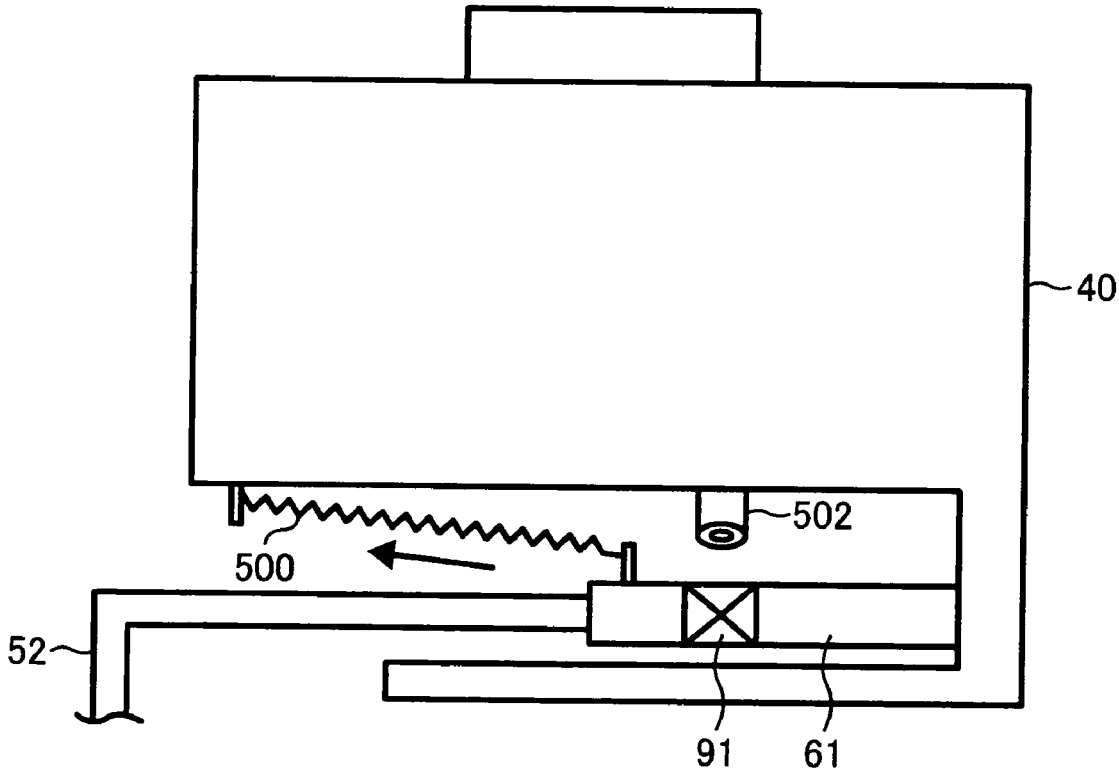
FIG. 9 is a cross section view of the shutter member integrally formed with the maintenance recovery unit shown in FIG. 2.

FIG. 9 shows the shutter member 61 integrally formed with the maintenance recovery unit 40, that is, attached to and supported by the maintenance recovery unit 40. Removing the maintenance recovery unit 40 from the body causes a tension spring 500 to pull the shutter member 61 in a direction indicated by an arrow in FIG. 9, and an opening 91 arranged in the shutter member 61 to move accordingly. As a result, the shutter member 61 blocks a waste ink discharge opening 502 of the maintenance recovery unit 40. Therefore, the ink leakage from the maintenance recovery unit 40 removed from the body may be prevented. When the removed maintenance recovery unit 40 is attached to the body, the maintenance recovery unit 40 is inserted to the body with the shutter member 61 moved in an open position.

When the waste liquid tank 50 integrally formed with the shutter member 61 is unloaded from the body, the same mechanism as described above referring to FIG. 9 is operative. Therefore, waste ink may be prevented from leaking from the waste liquid tank 50 even when the waste liquid tank 50 is inclined or upended.

When the unloaded waste liquid tank 50 is to be reloaded to the body, the waste liquid tank 50 is inserted to the body with the shutter member 61 moved in an open position.

The present disclosure is not limited to the above embodiment. The configuration of a shutter mechanism and a shape of a shutter member may be appropriately changed. Further, a shape of a shutter open close bracket which serves as a member for causing a shutter member to open and close is not limited. A maintenance recovery unit may adopt any method. When a mechanism including a pulley and a wire member is used, arrangement of the pulley and the wire member is not limited.

The number of ink colors is not limited to four. The configuration or the number of a head is not limited. An ink cartridge may be included in a head. The configuration of a scanner unit is not limited. An auto sheet feeder may be or may not be included. The present disclosure may be applied to a multifunction printer including facsimile and printer functions. The present disclosure may also be applied to a printer without a scanner unit.

The above specific embodiments are illustrative, and many variations can be introduced on these embodiments without departing from the spirit of the disclosure or from the scope of the appended claims. For example, elements and/or features of different illustrative embodiments may be combined with each other and/or substituted for each other within the scope of this disclosure and appended claims.

This patent specification is based on a Japanese patent application, No. JP2005-202975 filed on Jul. 12, 2005 in the Japan Patent Office, the entire contents of which are incorporated by reference herein.

What is claimed is:

1. An ink jet recording apparatus, comprising:

a recording head;

a maintenance recovery unit configured to maintain and restore a state of the recording head;

a waste liquid tank installed to, or removable from, the ink jet recording apparatus and configured to receive a waste liquid from the maintenance recovery unit when installed to the ink jet recording apparatus;

a shutter mechanism arranged between the maintenance recovery unit and the waste liquid tank and including a shutter member configured to move between a closed position to cause the maintenance recovery unit to be isolated from the waste liquid tank and an open position to cause the maintenance recovery unit to link to the waste liquid tank; and a holding member installable to, or removable from, the ink jet recording apparatus and configured to be inserted into the ink jet recording apparatus in a first direction towards an inner side of the ink jet apparatus while causing the shutter member to move to the open position in a second direction opposite to the first direction away from the inner side of the ink jet recording apparatus and to hold the shutter member at the open position.

2. The ink jet recording apparatus according to claim 1, wherein the holding member is removed from the ink jet recording apparatus in the second direction away from the inner side of the ink jet recording apparatus to cause the shutter member to move from the open position to the closed position in the first direction.

3. The ink jet recording apparatus according to claim 2, wherein the shutter mechanism further comprises:

a driving mechanism configured to cause the shutter member and the holding member to move in opposite directions.

4. The ink jet recording apparatus according to claim 3, wherein the driving mechanism comprises:

a rack-and-pinion mechanism including:

a first rack member mechanically linked to the shutter member so as to move in the same direction as the shutter member;

a second rack member mechanically linked to the holding member so as to move in the same direction as the holding member; and a pinion gear provided between the first rack member and the second rack member, wherein the holding member is configured to cause the shutter member to move through the rack-and-pinion mechanism.

5. The ink jet recording apparatus according to claim 4, wherein the shutter mechanism is configured to be concomitantly closed as the holding member is removed from the ink jet recording apparatus.

6. The ink jet recording apparatus according to claim 5, wherein the holding member is removed from the ink jet recording apparatus to allow removal of the waste liquid tank from the ink jet recording apparatus.

7. The ink jet recording apparatus according to claim 6, wherein the holding member is integrally formed with a member configured to fix the waste liquid rank to the ink jet recording apparatus.

8. The ink jet recording apparatus according to claim 6, further comprising:

a housing configured to be removed from the ink jet recording apparatus or opened to expose the interior of the ink jet recording apparatus to allow removal of the waste liquid tank from the ink let recording apparatus, wherein the holding member is integrally formed with the housing.

9. The ink jet recording apparatus according to claim 6, wherein the holding member is integrally formed with the waste liquid tank.

10. The ink jet recording apparatus according to claim 4, wherein a rack member is integrally formed with the shutter member.

11. The ink jet recording apparatus according to claim 3, wherein the driving mechanism comprises:

a mechanism including a pulley and a wire member, wherein the holding member is configured to cause the shutter member to move through the mechanism including a pulley and a wire member.

12. The ink jet recording apparatus according to claim 1, wherein the shutter mechanism is attached to and supported by the maintenance recovery unit, and the shutter mechanism is configured to be concomitantly closed as the maintenance recovery unit is removed from the ink jet recording apparatus.

13. An ink jet recording apparatus, comprising:

maintenance means for maintaining a state of a recording head of the ink jet recording apparatus;

waste liquid storage means for storing a waste liquid received from said maintenance means, when said waste liquid storage means is installed to the ink let recording apparatus;

shutter means for causing the maintenance means to be isolated from the waste liquid storage means by moving to a closed position, and causing the maintenance means to link to the waste liquid storage means by moving to an open position; and holding means installable to or removable from the ink jet recording apparatus for holding the shutter means at the open position when the holding means is installed to the ink jet recording apparatus, wherein the holding means is inserted into the ink jet recording apparatus in a first direction towards an inner side of the ink jet recording apparatus while causing the shutter means to move from the closed position to the open position in a second direction opposite to the first direction away from the inner side of the ink jet recording apparatus.

14. A method for maintaining an ink jet recording apparatus including a recording head, a maintenance unit, a waste liquid tank, a shutter member and a holding member installable to or removable from the ink jet recording apparatus, said method comprising:

operating the maintenance unit to maintain a state of the recording head;

storing a waste liquid received from the maintenance unit in the waste liquid tank;

moving the shutter member between a closed position to cause the maintenance unit to be isolated from the waste liquid tank and an open position to cause the maintenance unit to link to the waste liquid tank; and inserting the holding member into the ink jet recording apparatus in a first direction towards an inner side of the ink let recording apparatus while causing the shutter member to move to the open position in a second direction opposite to the first direction away from the inner side of the ink jet recording apparatus, and holding the shutter member at the open position.

* * * * *